United States Patent [19]

Watanabe et al.

[11] 4,216,788

[45] Aug. 12, 1980

[54] COIN PROCESSING MACHINE

[76] Inventors: Kenkichi Watanabe; Katusuke Furuya, both c/o Laurel Bank Machine Co., Ltd., No. 2, Toranomon, Shiba, Minato-ku, Tokyo, Japan

[21] Appl. No.: 933,025

[22] Filed: Aug. 11, 1978

[30] Foreign Application Priority Data

Aug. 15, 1977 [JP] Japan ..... 52-108923[U]

[51] Int. Cl.[2] ..... G07D 9/04

[52] U.S. Cl. ..... 133/8 R; 235/92 CN

[58] Field of Search ..... 133/8 R, 8 A, 8 B, 8 C, 133/8 D; 235/92 CN

[56] References Cited

U.S. PATENT DOCUMENTS

| | | | |
|---|---|---|---|
| 2,881,975 | 4/1959 | Bower | 133/8 R |
| 3,500,838 | 3/1970 | Seifert | 133/8 R X |
| 3,861,408 | 1/1975 | Hatanaka et al. | 133/8 R |
| 4,041,280 | 8/1977 | Ohsako et al. | 133/8 R X |

FOREIGN PATENT DOCUMENTS

| | | | |
|---|---|---|---|
| 47-27990 | 7/1972 | Japan | 133/8 R |

*Primary Examiner*—Joseph J. Rolla

[57] ABSTRACT

A coin processing machine for counting coins processes the counted coins by bringing the coins, which are guided into their path, into contact one by one with a counting gear, thereby to turn the counting gear. The coin processing machine includes pulse generating means which is connected to the shaft of rotation of the counting gear for generating two kinds of pulse signals having different phases. Also included is a rotational direction discriminating circuit which is made responsive to the pulse signals of the pulse generating means so that it may generate adding pulses when the shaft of the counting gear rotates in the forward direction, and subtracting pulses when the same rotates in the backward direction. A reversible counter is also included for counting either adding or subtracting pulses. Thus, the coin counting operations can always be accomplished correctly while ensuring normal processing of the coins.

3 Claims, 5 Drawing Figures

COIN PROCESSING MACHINE

BACKGROUND OF THE INVENTION

1. Field of the Invention

The present invention relates to a coin processing machine for counting coins to process the counted coins, and more particularly to a counting device for use with the coin processing machine for counting the coins, which are guided into their path, by bringing the coins one by one into contact with a counting gear to turn this gear.

2. Description of the Prior Art

A variety of coin processing machines, such as a coin packing machine or a coin counting machine, have heretofore been used to count a number of coins of the same or different kinds. Especially, the coin packing machine is made capable of packing a preset number of the counted coins with packing paper. For this purpose, such coin processing machine is normally equipped with a counting mechanism. A counter of mechanical type has been developed as such a counting mechanism. In this mechanical type counter, a gear is turned back and forth for the purpose of counting. Even if, therefore, the mechanism coactive with that gear is reversed when the coins jam up in their path, the counted number is correspondingly subjected to adding or subtracting operations so that it can be free from varying so much as to lead to mistakes. Such mechanical type counter has, however, a drawback in that it takes much time in the case of processing thousands of coins because its counting speed is considerably low.

In order to speed up the counting operation, there has also been developed a coin processing machine which is equipped with a counting mechanism using an electronic type counter. Since, however, the coin processing machine of electronic type has not such a function as to take out the signals indicative of backward rotations in case the counting mechanism is turned backward, the counted number for the backward rotation is also added and increased, with the resultant drawback of the mistaken counting operation.

SUMMARY OF THE INVENTION

It is, therefore, an object of the present invention to provide a coin processing machine which is free from any of the drawbacks concomitant with the prior art and which is equipped with such a counting mechanism as is made operative to count the coins, which are guided into their path, by bringing the coins one by one into contact with a counting gear, thereby to turn the gear.

Another but major object of the present invention is to provide a coin processing machine of the above type, in which the counting mechanism is so improved that no mistaken number is counted, even if the counting mechanism is turned in the backward direction.

According to a major feature of the present invention, there is provided a coin processing machine for counting coins to process the counted coins by bringing the coins, which are guided into their path, into contact one by one with a counting gear, thereby to turn the counting gear, said coin processing machine comprising: pulse generating means mounted to the shaft of rotation of said counting gear for generating two kinds of pulse signals having different phases; a rotational direction discriminating circuit responsive to said pulse signals for generating adding pulses when the shaft of said counting gear rotates in the forward direction, and for generating subtracting pulses when the same rotates in the backward direction; and a reversible counter for counting one of said adding pulses and said subtracting pulses.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENT

Figure 1:
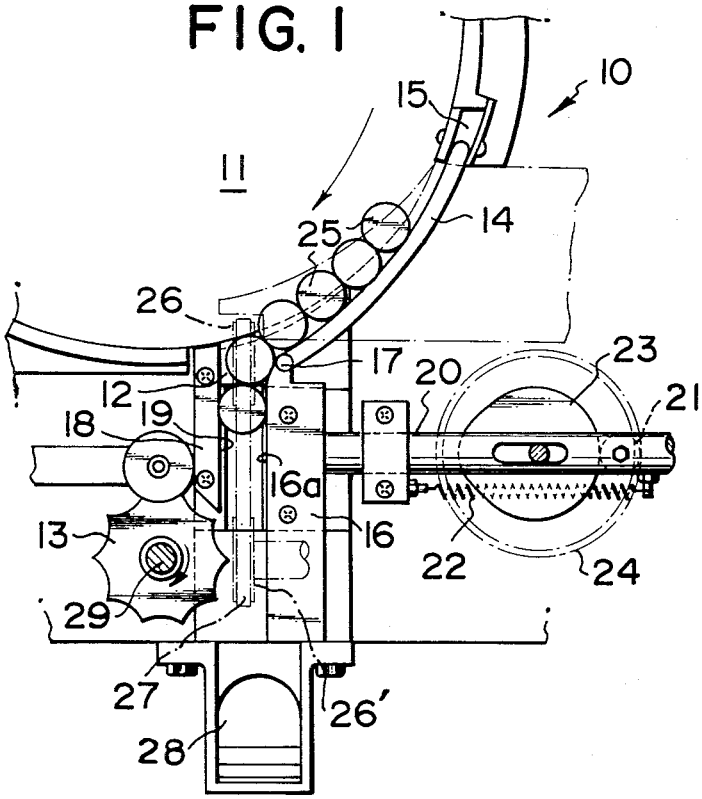
FIG. 1 is a top plan view showing the coin delivery mechanism of a coin processing machine exemplifying the present invention.

The present invention will now be described in connection with one embodiment thereof with reference to the accompanying drawings. FIG. 1 is a top plan view showing a coin processing machine 10 exemplifying the present invention, especially, its essential portions including a rotary disc 11, a coin path 12 and a counting gear 13. A guide rail 14 is made to have its one free end inserted into the recess 15 which is formed in the inner surface of the outer peripheral casing of the rotary disc 11, The other end of the guide rail 14 is pivotally connected to a selecting movable guide plate 16 by means of a pivot pin 17. A stationary guide plate 18 is arranged at a spacing from and substantially in parallel with the movable guide plate 16 so that the coin path 12 is defined between the two guide plates 16 and 18. A groove 19 is formed in the coin path 3 so that the coins smaller than that of a preset diameter may be selected to fall down from the groove 19. In order that the width of the coin path 12 can be varied, one end of an irrotational shaft 20 is connected to the selecting movable guide plate 16. To the other end of that shaft 20 is connected a roller 21 which is made coactive with the movable guide plate 16. This roller 21 is urged by a spring 22 into contact with a path width selecting cam 23 which is connected directly to an adjusting handle 24. In order to convey a series of coins 25 to the counting gear 13, there are arranged within the coin path 12 along the locus of their conveyance a pair of delivery pulleys 26 and 26', on which an endless conveyor belt 27 is made to run. Indicated at reference numeral 28 is a chute which is made to lead to a storage cylinder (not shown).

With those construction arrangements, the coins 25 on the rotary disc 11 are made to slide on the inner surface of the outer peripheral casing and to be received by the guide rail 14 so that they are guided along the guide rail 14 to a coin inlet (not numbered). When the coins 25 come close to the pivot pin 17, they are bitten by the delivery pulley 26 before they come into contact with the end portion of the stationary guide plate 18. At this instant, the delivery pulley 26 makes contact with the coins 25 at their eccentric positions so that the coins 25 are conveyed, while partly rotating counter-clockwise or in the directions of arrows and partly contacting with the left-hand side 16*a* of the movable guide plate 16, until they come into contact with the counting gear 13. Every time the coins 25 thus contacting turn the counting hear 13 by a preset angle, their counting operations are carried out. The coins 25 are then made to fall down, one by one, into the chute 28 of the storage cylinder.

Figure 2:
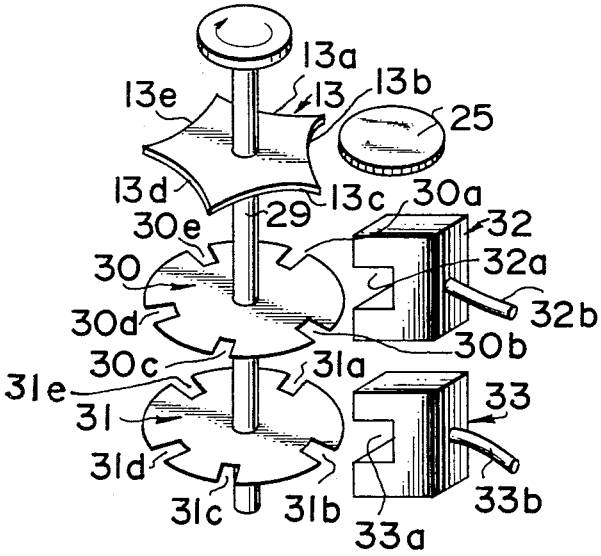
FIG. 2 is an enlarged perspective view showing the pulse generating device of the coin processing machine of the present invention.

Turning to FIG. 2, the description will now be detailed as to the counting mechanism which plays an important role in the coin processing machine of the present invention. The counting gear 13 is constructed to have its shaft of rotation 29 equipped fixedly with an A pulse generating disc 30 and a B pulse generating disc 31, both of which are positioned below the counting gear 13 with respect to the axial direction of the shaft 29 and with a preset spacing therebetween. As shown, the counting disc 13 is formed into a pentagonal shape, which has its five sides formed with such recesses 13*a* to 13*e* as are curved inwardly with a curvature slightly larger than that of the coins 25. The two pulse generating discs 30 and 31 are accordingly formed with notches 30*a* to 30*e* and 31*a* to 31*e*, respectively, which correspond to the recesses 13*a* to 13*e* of the counting gear 13. Those notches 30*a* to 30*e* and 31*a* to 31*e* are made to have the same size and shape. Also provided are two non-contact switches 32 and 33 which are made coactive with the pulse generating discs 30 and 31, respectively. As seen from close reference to FIG. 2, the sides of those non-contact switches 32 and 33, which face their corresponding pulse generating discs 30 and 31, are respectively formed with recesses 32*a* and 33*a*, which are made operative to detect the notches 30*a* to 30*e* and 31*a* to 31*e*, respectively. The switch 32 is so positioned that the notches 30*a* to 30*e* of the pulse generating disc 30 may rotate within the recess 32*a* of the switch 32, while the switch 33 is so positioned that the notches 31*a* to 31*e* of the pulse generating disc 31 may rotate within the recess 33*a* of the switch 33. These non-contact switches 32 and 33 are made operative to generate electric signals A and B (or forward rotation pulses $A_1$ and $B_1$ and backward rotation pulses $A_2$ and $B_2$, which will be described later in more detail) at their respective terminals 32*b* and 33*b* when they detect either a magnetic or non-magnetic member.

Here, it is assumed that the forward rotation takes place when the counting gear 13 and the pulse generating discs 30 and 31 rotate clockwise or in the directions of arrows, and that the backward rotation takes place when the same rotate counter-clockwise. Those two pulse generating discs 30 and 31 are then positioned such that, in the process of forward rotation, the output pulses A from the switch 32 are advanced in phase from the output pulses B from the switch 33, as seen from FIG. 4, while, in the process of backward rotation, the output pulses A are retarded in phase from the output pulses B, as seen from FIG. 5. In accordance with the above positioning, moreover, the respective "0" level portions of the two signals A and B are overlapped in the operations of both forward and backward rotations.

Figure 3:
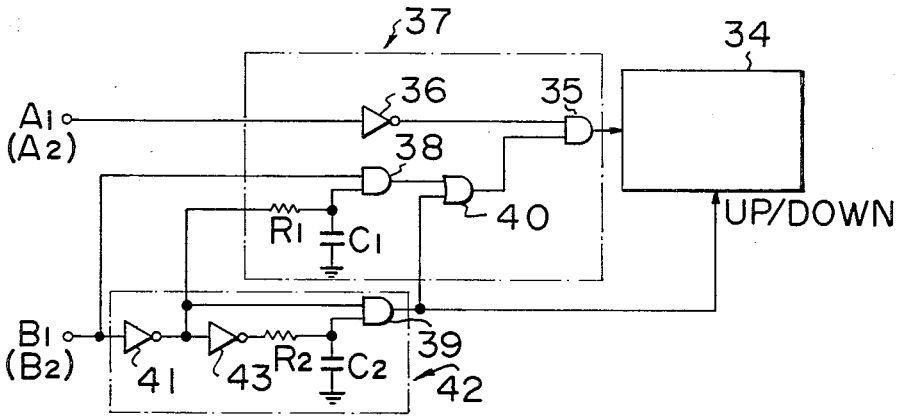
FIG. 3 is a diagrammatical illustration showing the circuity to be used with the coin processing machine of the present invention.

FIG. 3 is a diagrammatical representation showing circuity which is responsive to the pulse signals $A_1$ (or $A_2$) and $B_1$ (or $B_2$) from the above-described non-contact switches 32 and 33 so as to produce such counting pulses as are different for the forward and backward rotations and to feed the counting pulses to a reversible counter 34, thereby to count the counting pulses. More specifically, those pulse signals $A_1$ (or $A_2$) are fed to a first terminal of an AND gate 35 via the inverter 36 of a counting signal generating circuit 37. The second input terminal of that AND gate 35 is supplied with outputs of both AND gates 38 and 39 via an OR gate 40. Thus, the output of the AND gate 35 is the aforementioned counting pulses, which are fed to the reversible counter 34 for the counting purpose. On the other hand, the pulse signals $B_1$ (or $B_2$) are fed not only to the first input terminal of the AND gate 38 but also to the second input terminal of the same via the inverter 41 of a forward-backward rotation detecting circuit 42 and via a resistor $R_1$. The second terminal of the AND gate 38 is connected to one end of a capacitor $C_1$ which has its other end grounded to the earth. As a result, after the pulse signals $B_1$ (or $B_2$) are changed from "0" to "1" of binary logic levels, the AND gate 38 produces the pulse signals at the "1" level. Here, the AND gate 35 is regulated by the inverted signals which are prepared by inverting the pulse signals $A_1$ (or $A_2$) with the use of the inverter 36. As seen from FIG. 5, therefore, the output pulses of the AND gate 38 resulting from the pulse signals $B_2$ when in the backward rotation are fed as the counting pulses to the reversible counter 34 via the OR gate 40 and the AND gate 35.

The signals which are prepared by inverting the pulse signals $B_1$ (or $B_2$) with the use of the inverter 41 are then fed directly to the first input terminal of the AND gate 39 as well as to the second input terminal of the same via an inverter 43 and a resistor $R_2$. The second terminal of the AND gate 39 is connected to one end of a capacitor $C_2$ which has its other end grounded to the earth. As a result, after the pulse signals $B_1$ (or $B_2$) are changed from "1" to "0" level, the AND gate 39 produces the pulse signals at the "1" level. Here, the AND gate 35 is opened when the pulse signals $A_1$ (or $A_2$) are at the "0" level, as has been described in the above. As seen from FIG. 4, therefore, the output pulses of the AND gate 39 resulting from the pulse signals $B_1$ when in the forward rotation are fed as counting pulses to the reversible counter 34 via the OR gate 40 and the AND gate 35.

The output signals of the AND gate 39 are further fed as control signals to the up/down terminal of the reversible counter 34. In this instance, the reversible counter 34 is made into such an element as can effect the adding operation, when the control input at the up/down terminal is at the "1" level, and the subtracting operation when the same input is at the "0" level. This, as seen from FIGS. 4 and 5, has the result that the circuity exemplifying the present invention has the same output at the AND gates 35 and 39 when in the forward rotation mode while having different outputs when in the backward rotation mode.

Figure 4:
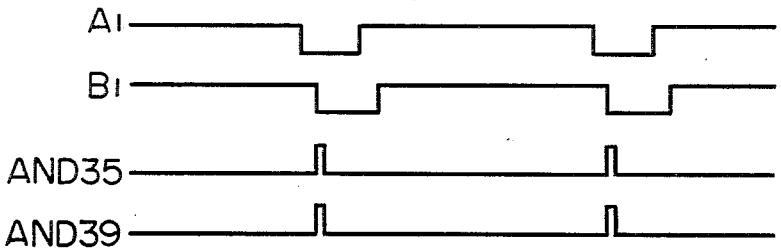
FIG. 4 is a time chart illustrating the operations of the circuity shown in FIG. 3.
Figure 5:
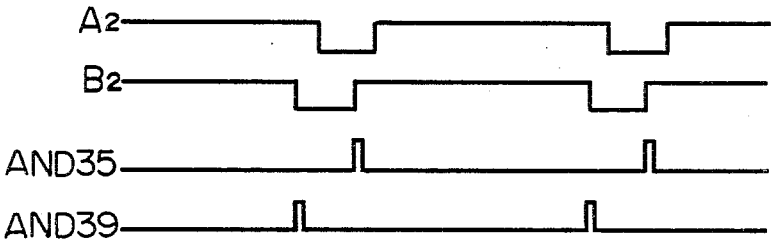
FIG. 5 is similar to FIG. 4 but illustrates the other operations of the circuit of FIG. 3.

Now, the counting operations will be described in detail in the following. When in the forward rotation, the coins 25 are conveyed one by one into consecutive contact with the respective sides 13*a* to 13*e* of the counting gear 13 so that this gear is turned by a preset angle. At each time, the forward rotation pulses $A_1$ and $B_1$ shown in FIG. 4 are generated at the non-contact switches 32 and 33 and fed to the circuits 37 and 42 of FIG. 3. As has been described, the pulses, which are synchronized with such pulses are generated by the AND gate 39 immediately after the pulse signals $B_1$ are inverted from the "1" to "0" level, are produced by the AND gate 35 and fed as the counting pulses to the reversible counter 34. At the same time, the up/down terminal of the reversible counter 34 is supplied with the output pulses of the AND gate 39 at the "1" level, which are interpreted as up-counting pulses by the reversible counter 34.

When in the backward rotation, on the other hand, the backward rotation pulses $A_2$ and $B_2$ are fed to the two circuits 37 and 42. At this time, the pulses, which are synchronized with such pulses as are generated by the AND gate 38 immediately after the backward rotation pulses $B_2$ are inverted from the "0" to "1" level, are produced by the AND gate 35 and fed as the counting pulses to the reversible counter 34. At this time, the up/down terminal of the reversible counter 34 is supplied, as seen from FIG. 5, with the output pulses of the AND gate 39 at the "0" level so that the reversible counter 34 accomplishes its down-counting or subtracting operation to subtract the input pulses.

In order to remove the coins 25 jamming up their path 12, on the other hand, the forward and backward rotation pulses are generated in an alternate manner, as will be described hereinafter. In case the counting gate 13 rotates backward during the time period when the forward rotation pulses $B_1$ are changed from the "0" to "1" level after the counting pulses are generated by the AND gate 35 from the forward rotation pulses $A_1$ and $B_1$, as seen from FIG. 4, then the backward rotation pulses $A_2$ and $B_2$ are produced. In case the backward rotation pulses $B_2$ are changed from the "0" to "1" level, as seen from FIG. 5, one counting pulse is generated by the AND gate 35 and used to subtract the pulse, which are added in advance by the reversible counter 34, so that the counted number can assume a normal value. In case the forward and backward rotations are repeated under the condition having the backward rotation pulses $B_2$ within the range of the "0" level, there is produced no counting pulse so that the counted value of the reversible counter 34 is kept unchanged, thus maintaining the normal value until that time. In these ways, the counted number in any case can be maintained at the normal value and can be free from any deviation.

As is apparent from the description thus made hereinbefore, it should be appreciated as an advantage of the present invention that the counting operations of coins can always be accomplished correctly with the use of a simple mechanism while ensuring normal processing of the coins.

What is claimed is:

1. A coin processing machine for counting coins to process the counted coins by bringing one by one the coins, which are guided into their path, into contact with a counting gear thereby to turn the counting gear, comprising:

a shaft mounted to said counting gear for rotation therewith;

pulse generating means mounted to the shaft for generating two groups of pulse signals having different phases;

rotational direction discriminating circuit means responsive to said pulse signals for generating adding pulses when the shaft rotates in the forward direction and subtracting pulses when the shaft rotates in the backward direction; and reversible counter means for counting one of said adding pulses and said subtracting pulses.

2. A coin processing machine defined in claim 1 wherein said pulse generating means comprises two pulse generating discs mounted to said shaft and spaced from each other along said shaft, each of said pulse generating discs having a plurality of notches equally spaced along the periphery thereof; and two non-contact switches, each positioned adjacent to a respective one of said discs so that each generates a respective one of said groups of pulse signals having different phases.

3. A coin processing machine defined in claim 1, wherein said rotational direction discriminating circuit means comprises a counting signal generating circuit for generating count pulses from one of said groups of pulse signals, and a forward-backward rotation detecting circuit for generating further pulses from said two groups of pulse signals so as to cause said count pulses to be added by said reversible counter when the shaft of said counting gear rotates forwardly and to be subtracted by said reversible counter when the shaft of said counting gear rotates backwardly.

* * * * *

UNITED STATES PATENT AND TRADEMARK OFFICE

CERTIFICATE OF CORRECTION

PATENT NO. : 4,216,788

DATED : August 12, 1980

INVENTOR(S) : Kenkichi Watanabe et al.

It is certified that error appears in the above—identified patent and that said Letters Patent is hereby corrected as shown below:

On the Title Page, Insert

-- (73) Assignee: Laurel Bank Machine Co., Ltd. --.

Signed and Sealed this

Sixth Day of January 1981

[SEAL]

*Attest:*

SIDNEY A. DIAMOND

*Attesting Officer*

*Commissioner of Patents and Trademarks*